United States Patent [19]

Ako

[11] Patent Number: 4,995,424

[45] **Date of Patent: * Feb. 26, 1991**

[54] DIRECTIONAL CONTROL VALVE

[75] Inventor: Hidenobu Ako, Ogaki, Japan

[73] Assignee: Teijin Seiki Co., Ltd., Osaka, Japan

[ * ] Notice: The portion of the term of this patent subsequent to Apr. 3, 2007 has been disclaimed.

[21] Appl. No.: 480,844

[22] Filed: Feb. 16, 1990

Related U.S. Application Data

[63] Continuation-in-part of Ser. No. 326,884, Mar. 20, 1989, Pat. No. 4,913,191.

[51] Int. Cl.[5] ..... F15B 13/04

[52] U.S. Cl. ..... 137/596; 91/438

[58] Field of Search ..... 137/596; 91/438

[56] References Cited

U.S. PATENT DOCUMENTS 2,362,349 11/1944 Bryant .
3,020,008 2/1962 Rumsey .
3,138,072 6/1964 Gray .
3,403,601 10/1968 Eddy .
3,712,339 1/1973 Bartholomaus et al. ... 137/625.64 X
4,913,191 4/1990 Ako ..... 137/596

FOREIGN PATENT DOCUMENTS 1267957 6/1961 France .

*Primary Examiner*—Gerald A. Michalsky
*Attorney, Agent, or Firm*—Burgess, Ryan & Wayne

[57] ABSTRACT

A four way directional control valve comprises a valve body having a sleeve formed therein, a spool slidable in the sleeve, two output ports, a pump port and two tank ports formed in the valve body so that the output ports can be a pressure side and an exhaust side by operation of the spool. The four way directional valve further comprises a communicating passage formed in the valve body to provide communication of the output ports with each other, a fixed orifice disposed in the communicating passage, a control passage, formed in parallel with the communicating passage, a control spool disposed in the control passage movable in response to a differential pressure between the output ports to block the communicating passage.

2 Claims, 3 Drawing Sheets

DIRECTIONAL CONTROL VALVE

CROSS REFERENCE TO RELATED APPLICATION

This application is a Continuation-in-Part application of U.S. Ser. No. 326,884, filed on Mar. 20, 1989, now U.S. Pat. No. 4,913,191.

BACKGROUND OF THE INVENTION

The present invention relates to a directional control valve. More specifically, the present invention relates to a directional control valve, such as a four way directional control valve or a two way directional control valve.

For example, in a four way directional control valve, when the two output ports are blocked, the rate of change of the differential pressure between both the output ports relative to the displacement of the spool is referred to as "blocked pressure gain".

In a four way directional control valve having a metering position, since the communication of the ports is switched at the neutral position of the spool, theoretically speaking, the blocked pressure gain must be infinite at the switching position under the zero lap condition.

However, in an actual valve, because there are clearances between the sleeve and the spool, a small amount of working fluid leaks through the clearances, and therefore, the observed pressure gain is finite as illustrated in FIG. 3.

It is usual in commercially available four way control valves that the maximum differential pressure, i.e., 100% pressure, is obtained at a spool stroke between 5 and 20 micron meter.

In the meantime, it has been observed that the pressure gain as illustrated in FIG. 3 is too large for a circuit for chucking a fragile article or for a circuit for actuating simultaneously hydraulic equipment disposed in parallel, for example, in an aircraft, wherein a so called "force fight" may occur easily because a plurality of actuators are disposed. In such a case, a circuit as illustrated in FIG. 4, i.e., cross bleeding, has been often used to lower the blocked pressure gain.

More specifically, two output ports 5 and 6 are communicated with each other via a fixed orifice 22, and bleeding therebetween is permitted.

When the blocked pressure gain is lowered by cross bleeding which is illustrated in FIG. 4, the obtained pressure gain typically draws such a curve as illustrated in FIG. 5.

However, there occur the following problems if a directional control valve having a pressure gain as illustrated in FIG. 5 is used.

Since bleeding of the pressure occurs through the fixed orifice 22 communicating both the output ports 5 and 6, the required maximum pressure cannot be achieved. In other words, in a control system having this directional control valve installed therein, the power of the pressure in the system cannot be fully utilized.

In addition, as is apparent from FIG. 5, since the pressure gain is not linear, the gain nears zero at region where the differential pressure is relatively high. Accordingly, in an actual control system, a steady-state deviation increases beyond an acceptable level under a large load.

SUMMARY OF THE INVENTION

It is an object of the present invention to provide a directional control valve which can obviate the abovedescribed problems.

It is another object of the present invention to provide a directional control valve which can offer the maximum pressure.

It is a further object of the present invention to provide a directional control valve wherein the pressure gain is substantially constant over almost the entire spool displacing region.

The present invention achieves the above-described objects by a directional control valve comprising a valve body having a sleeve formed therein, a spool slidable in the sleeve, two output ports, a pump port and two tank ports formed in the valve body, the ports and the spool arranged so that the output ports can operate at an output pressure or an exhaust pressure by operation of the spool, the directional control valve further comprising:

(a) a communicating passage formed in the valve body connecting the output ports with each other to permit a flow of fluid between the output ports;

(b) a fixed orifice disposed in the communicating passage;

(c) a control passage arranged in parallel with the communicating passage, in communication with the output ports; and (d) a control spool disposed in the control passage, the control spool movable in response to a differential pressure between the output ports to block said communicating passage to provide a maximum output pressure.

BRIEF DESCRIPTION OF THE DRAWINGS

An embodiment of the present invention will now be explained in detail with reference to the accompanying drawings, wherein.

PREFERRED EMBODIMENTS

Figure 1:
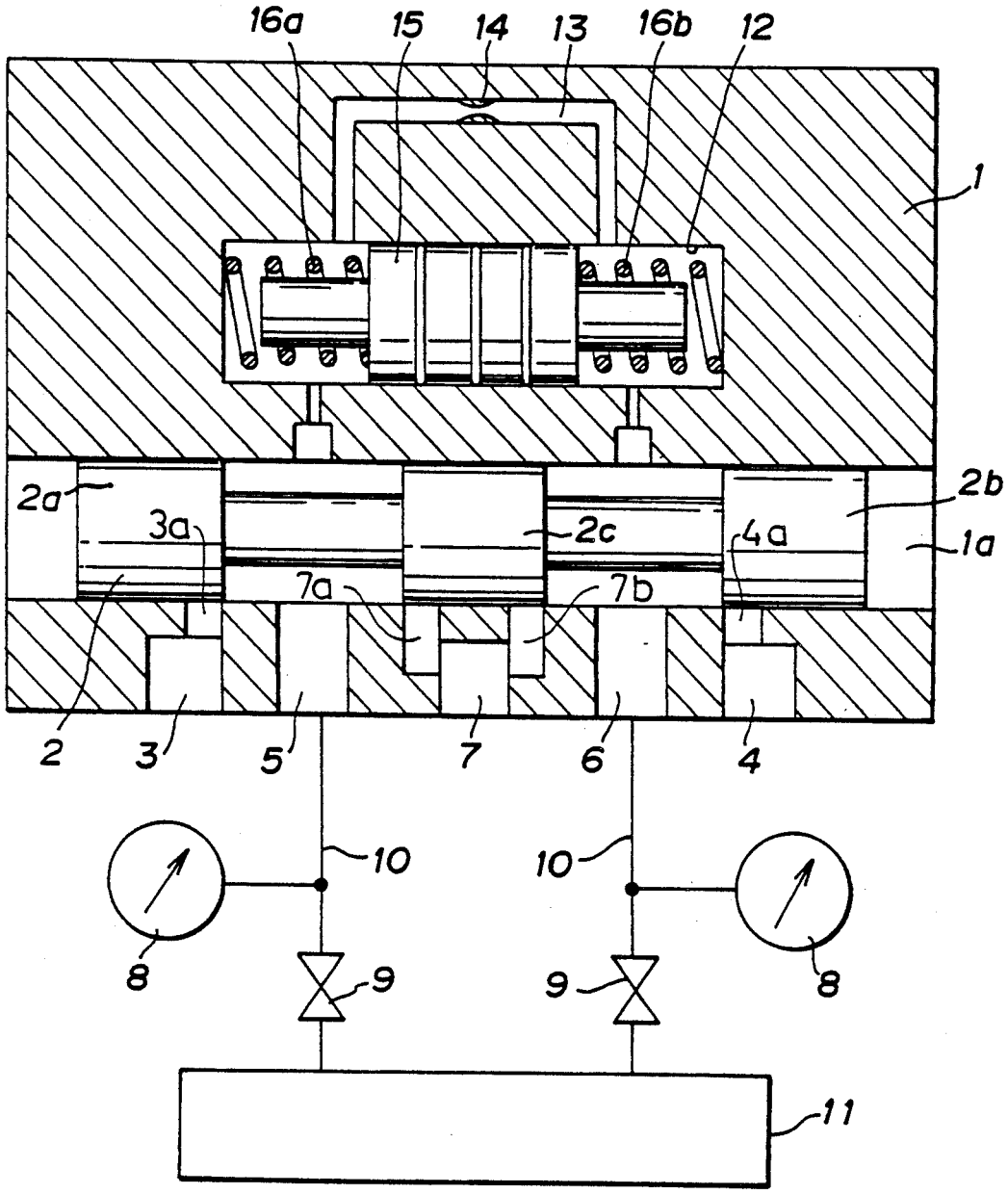
FIG. 1 is a cross sectional view of an embodiment of four way directional control valve according to the present invention.

In FIG. 1, a four way directional valve of the present invention comprises a valve body 1, which has a sleeve 1*a* bored therein.

A spool 2 is slidably and sealingly inserted into the sleeve 1*a*, and is actuated manually, or pneumatically, mechanically or electro-magnetically by an actuating means as it is common in a conventional directional control valve which means is not illustrated. The spool 2 has lands 2*a*, 2*b* and 2*c* formed thereon.

The sleeve 1*a* communicates with tank ports 3 and 4 via openings 3*a* and 4*a* output ports 5 and 6, and a pump port 7 via openings 7*a* and 7*b*.

The tank ports 3 and 4 may be connected to each other in the valve body 1.

The output ports 5 and 6 are communicated with an actuator 11 through pipes 10 and valves 9. Reference numeral 8 denotes a pressure gauge for measuring the respective pressure in the respective pipe 10.

A return ports 3 and 4, i.e., the tank ports 3 and 4, are used to release working fluid in the sleeve 1*a* to a supplied with working fluid from a pump (not illustrated).

The above-described construction is similar to that of a conventional four way directional control valve.

In the four way directional control valve of the present invention, the output ports 5 and 6 are also communicated with each other by a communicating passage 13, which has a fixed orifice 14 mounted therein.

A control passage 12 for switching the communicating passage 13 is formed in parallel with the communicating passage 13. A control spool 15 is slidably and sealingly disposed in the control passage 12.

Compression springs 16*a* and 16*b* are disposed in the control passage 12 to urge the ends of the control spool 15 and maintain the control spool 15 at a neutral position under a normal condition.

According to the present invention which has a construction as described above, when the spool 2 is, for example, moved to the right, working fluid supplied from the pump port 7 flows into the left output port 5. The working fluid flows from the left output port 5 into the control passage 12, from where it passes through the left side of the communicating passage 13, the fixed orifice 14 and the opposite side, i.e., the right side, of the communicating passage 13, and then, it also flows into the right output port 6.

As a result, the four way directional control valve of this embodiment operates in a manner similar to that of a conventional directional control valve of a bleeding type.

When the differential pressure between the output port 5 and 6 becomes large, the control spool 15 is almost moved to one end, i.e., to the right end in this embodiment, by the differential pressure, and therefore, the right end of the communicating passage 13 is covered by the periphery of the control spool 15 and is closed by the control spool 15.

Accordingly, the bleeding pressure which has been generated by the working fluid flowing between the output ports 5 and 6 through the communicating passage 13 and the fixed orifice 14 disappears, and therefore, the decrease of the pressure gain at a region where the differential pressure is large can be prevented.

The above explanation has been done with reference to the case wherein the spool 2 is moved to the right. However, when the spool 2 is moved to the left, an operation similar to that described above takes place, and similarly, the decrease of the pressure gain at a region where the differential pressure is large can be prevented.

Figure 2:
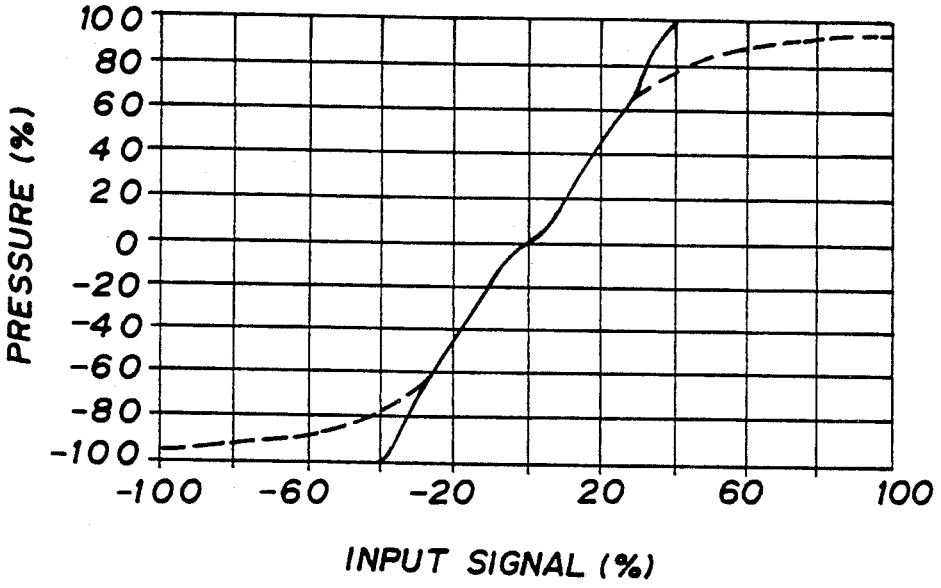
FIG. 2 is a diagram of a pressure gain of the directional control valve illustrated in FIG. 1, while a broken line in FIG. 2 denotes a pressure gain according to a conventional cross bleeding.
Figure 3:
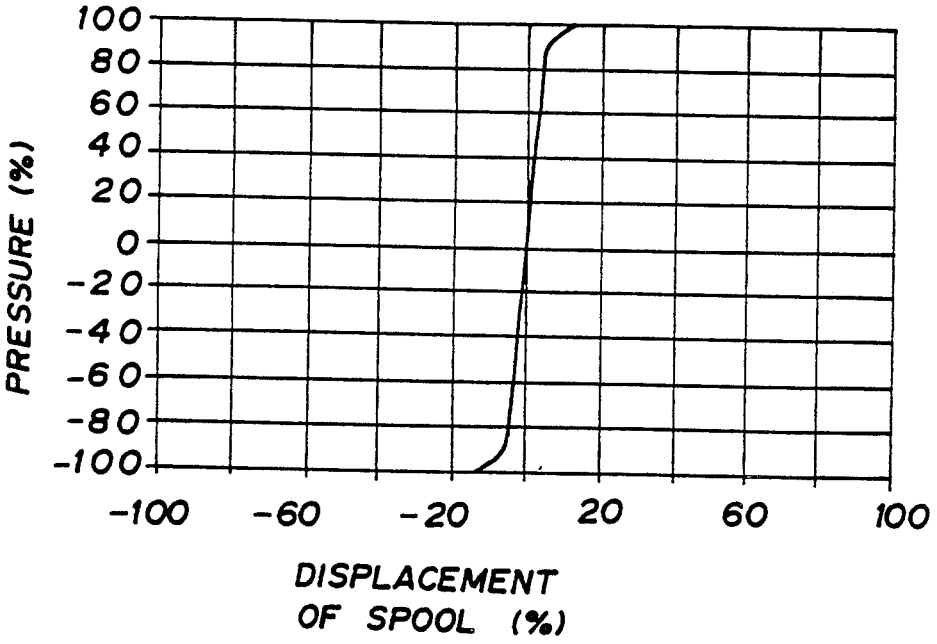
FIG. 3 is a diagram of pressure gain of a four way directional control valve wherein cross bleeding is not applied.
Figure 4:
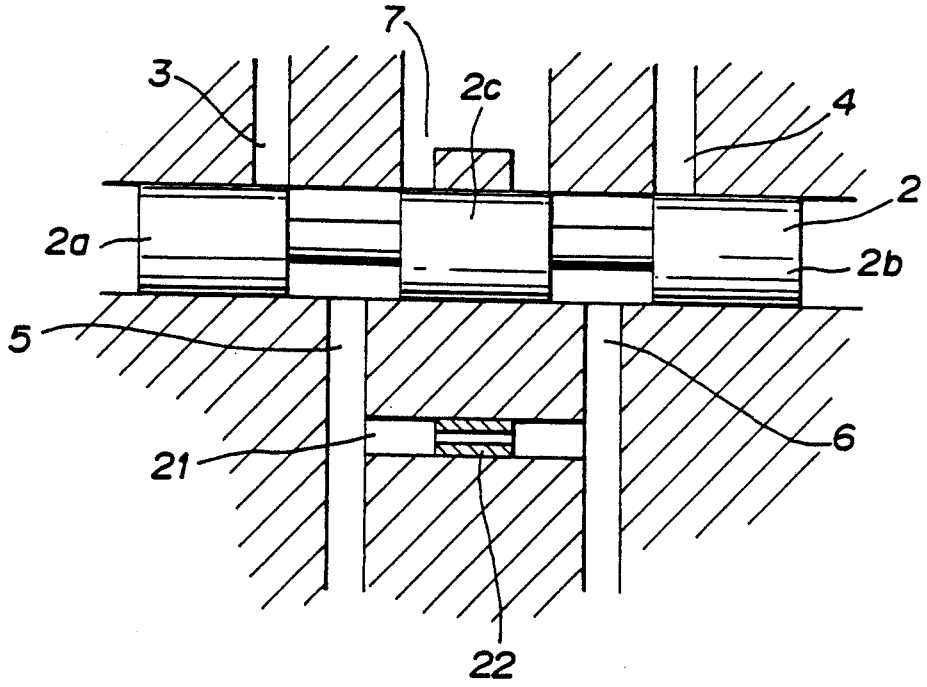
FIG. 4 PRIOR ART
FIG. 4 is a cross sectional view of a directional control valve wherein cross bleeding is applied.
Figure 5:
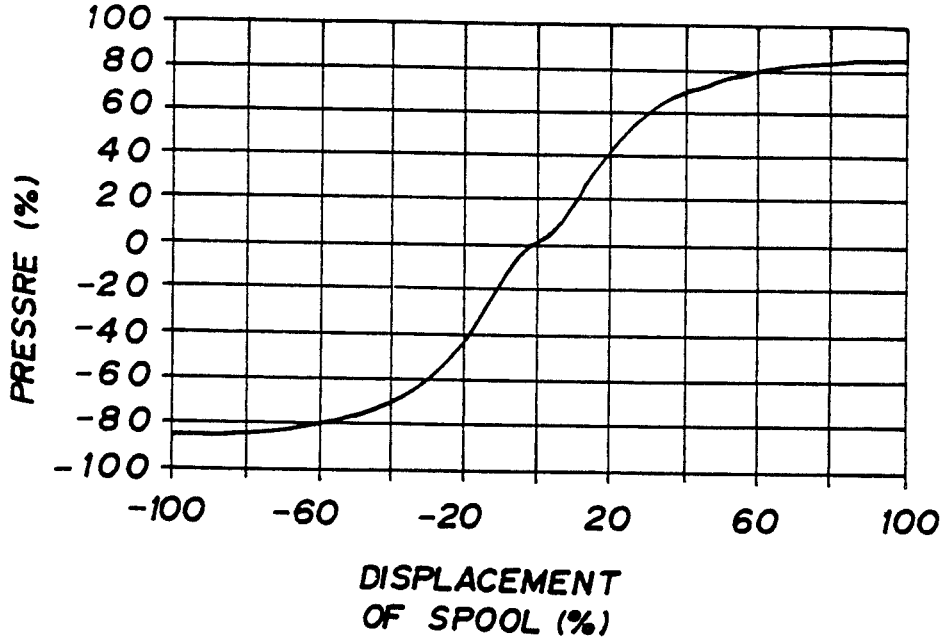
FIG. 5 PRIOR ART
FIG. 5 is a diagram of a pressure gain of a directional control valve wherein cross bleeding is applied.

A pressure gain diagram of the embodiment according to the present invention is illustrated in FIG. 2.

As it is apparent from the solid line in FIG. 2, the pressure gain is almost constant according to the present invention over almost the entire region of spool displacement. Broken lines in FIG. 2 denote a pressure gain of a conventional directional control valve of a bleeding type.

The foregoing explanation has been done with regard to an embodiment of a four way directional control valve, however, the present invention is also applicable to a two way directional control valve. In this case, as it is well known, a two way directional control valve comprises a valve body having a sleeve formed therein, a spool slidable in the sleeve, an output port and a pump port formed in the valve body. Therefore, according to the present invention, the two way directional control valve further comprises a communicating passage formed in the valve body so as to communicate the output port with the pump port, a fixed orifice disposed in the communicating passage, a control passage, formed in parallel with the communicating passage, for switching the communicating passage, and a control spool disposed in the control passage movable in response to differential pressure between the output port and the pump port.

According to the present invention, the pressure gain of a directional control valve can be substantially constant, i.e., linear, over almost the entire region where the spool displaces. Further, according to the present invention, the maximum pressure can be generated. As a result, the problem that a steady-state deviation increases beyond the acceptable level can be obviated and the power of the system pressure can be fully utilized.

What is claimed is:

1. A directional control valve comprising a valve body having a sleeve formed therein, a spool slidable in said sleeve, two output ports, a pump port and two tank ports formed in said valve body, said ports and said spool arranged so that said output ports can operate at an output pressure or an exhaust pressure by operation of said spool, the directional control valve further comprising:

(a) a communicating passage formed in said valve body connecting said output ports with each other to permit a flow of fluid between said output ports;

(b) a fixed orifice disposed in said communicating passage;

(c) a control passage arranged in parallel with said communicating passage, in communication with said output ports; and (d) a control spool disposed in said control passage, said control spool movable in response to a differential pressure between said output ports to block said communicating passage to provide a maximum output pressure.

2. A directional control valve comprising a valve body having a sleeve formed therein, a spool slidable in said sleeve, two output ports, two openings communicating with at least one pump port and two openings communicating with at least one tank port, each of said openings being formed at an inner wall of said sleeve, said ports and said spool arranged so that said output ports can operate at an output pressure or an exhaust pressure by operation of said spool, the directional control valve further comprising:

(a) a communicating passage formed in said valve body connecting said output ports with each other to permit a flow of fluid between said output ports;

(b) a fixed orifice disposed in said communicating passage;

(c) a control passage arranged in parallel with said communicating passage, in communication with said output ports; and (d) a control spool disposed in said control passage, said control spool movable in response to a differential pressure between said output ports to block said communicating passage to provide a maximum output pressure.

* * * * *